US005523655A

United States Patent [19]

Jennato et al.

[11] Patent Number: 5,523,655

[45] Date of Patent: Jun. 4, 1996

[54] NEON FLUORESCENT LAMP AND METHOD OF OPERATING

[75] Inventors: Scott D. Jennato, Candia; Harold L. Rothwell, Jr., Hopkinton, both of N.H.; George J. English, Reading, Mass.

[73] Assignee: Osram Sylvania Inc., Danvers, Mass.

[21] Appl. No.: 298,896

[22] Filed: Aug. 31, 1994

[51] Int. Cl.[6] ..... H05B 41/16

[52] U.S. Cl. ..... 315/246; 315/326; 315/358; 315/DIG. 2; 315/DIG. 5; 313/572; 313/573; 313/576; 313/642; 313/643

[58] Field of Search ..... 315/246, 219, 315/209 R, 186, 202, 326, 348, 358, DIG. 2, DIG. 5; 313/572, 576, 573, 641, 642, 643; 445/6

[56] References Cited

U.S. PATENT DOCUMENTS

| | | | |
|---|---|---|---|
| 1,792,347 | 2/1931 | Zecher . | |
| 2,152,999 | 4/1939 | Milner | 176/122 |
| 2,207,174 | 7/1940 | Jenkins | 176/122 |
| 2,421,571 | 6/1947 | Leyshon | 313/491 |
| 3,067,356 | 12/1962 | Ray | 313/221 |
| 3,536,945 | 10/1970 | Skirvin | 313/109 |
| 3,717,781 | 2/1973 | Sadoski et al. | 313/109 |
| 3,778,662 | 12/1973 | Johnson | 313/109 |
| 4,039,889 | 8/1977 | Vicai | 313/487 |
| 4,093,893 | 6/1978 | Anderson | 315/48 |
| 4,171,501 | 10/1979 | Tanimizu et al. | 313/486 |
| 4,196,374 | 4/1980 | Witting | 315/58 |
| 4,266,166 | 5/1981 | Proud et al. | 315/248 |
| 4,461,981 | 7/1984 | Saikatsu et al. | 315/246 |
| 4,549,110 | 10/1985 | Berman et al. | 313/485 |
| 4,792,727 | 12/1988 | Godyak | 315/176 |
| 4,870,323 | 9/1989 | Parks, Jr. et al. | 313/546 |
| 4,882,520 | 11/1989 | Tsunekawa et al. | 313/643 |
| 4,884,009 | 11/1989 | Rothwell, Jr. et al. | 315/246 |
| 4,914,347 | 4/1990 | Osawa et al. | 313/485 |
| 4,924,141 | 5/1990 | Taubner et al. | 313/488 |
| 4,926,095 | 5/1990 | Shinoda et al. | 315/169.4 |
| 4,996,465 | 2/1991 | Uetsuki | 315/358 |
| 5,030,894 | 7/1991 | Yoshiike et al. | 315/335 |
| 5,034,661 | 7/1991 | Sakurai et al. | 315/207 |
| 5,043,627 | 8/1991 | Fox | 313/491 |
| 5,072,155 | 12/1991 | Sakurai et al. | 315/219 |
| 5,132,590 | 7/1992 | Kimoto et al. | 313/485 |
| 5,159,237 | 10/1992 | Ishikawa et al. | 313/486 |
| 5,272,406 | 12/1993 | Chakrabarti et al. | 313/25 |
| 5,410,216 | 4/1995 | Kimoto et al. | 313/485 |

FOREIGN PATENT DOCUMENTS 2092383 9/1993 Canada .

*Primary Examiner*—Robert Pascal
*Assistant Examiner*—Haissa Philogene
*Attorney, Agent, or Firm*—William E. Meyer

[57] ABSTRACT

A nearly pure neon is described along with a method of operating the lamp. A phosphor is coated on the lamp wall. By properly stimulating the neon, ultraviolet light may be emitted, that can stimulate the phosphor to a first light emission. The lamp may then be operated to produce a visible light emission that is the result of neon emission or of intermediate combinations of the neon and phosphor emissions. A single neon lamp may then produce in one instance, an amber color, or in other instance, a red color without the cold environment problems typical of a mercury based lamp. The output efficiency is enhanced when the lamp is formed as an aperture lamp. The narrow source is also useful as a source in reflector and lens systems. High pressure neon lamps offer a small source size, direct color with no filtering, good tolerance of impact and jarring, moderate cost, and increased vehicle styling potential.

52 Claims, 5 Drawing Sheets

PRIOR ART FIG. 1

NEON FLUORESCENT LAMP AND METHOD OF OPERATING

TECHNICAL FIELD

The invention relates to electric lamps and particularly to rare gas discharge lamps. More particularly the invention is concerned with a method of constructing and operating a neon gas discharge fluorescent lamp with no mercury.

BACKGROUND ART

In common mercury vapor fluorescent lamps, the enclosed mercury vapor is stimulated to emit invisible ultraviolet light that in turn excites a phosphor coating on the lamp wall. The stimulated phosphor then emits the visible light. Mercury based fluorescent lamps do not work well in cold environments. The available mercury vapor existing at normal temperatures is progressively reduced with lower temperature. FIG. 1 shows the lumen output of a fluorescent lamp operated at different temperatures. There is about a 62 percent drop in light output from 25° C. (77° F.) to 13.9° C. (57° F.), and a 92 percent drop from 25° C. (77° F. ) to −31.1° C. (−24° F.). Light output is then so variable over normal temperatures that ordinary mercury fluorescent lamps are not normally used outside. Otherwise, fluorescent lamps are well know to be efficient, and long lived. There has been a long need for a fluorescent type lamp that can operate in cold environments.

Mercury free, rare gas, fluorescent lamps have been attempted in the past. Argon, krypton, and xenon lamps have been operated with phosphors, under a variety of conditions. For neon, it was known that if the lamp was operated at less than 5 Torr, the gas atoms had sufficient time between collisions to emit ultraviolet light to stimulate a phosphor. Unfortunately, at such low pressures, the phosphor disintegrates, and the electrodes rapidly sputter. As a result, while a lamp may start, it has a short life. At higher pressures, and operated in the usual way, ultraviolet emission was quenched.

Neon lamps are known to produce red light, and therefore offer the opportunity of an unfiltered vehicle stop lamp. There are however problems to be overcome. Typical neon sign lamps use long tubes about one or two centimeters in diameter, that contain the diffused gaseous neon plasma light source. These lamps typically have inputs from 1100 to 1200 volts, at a few milliamps of power. These lamps give off a diffuse, low intense light. For proper visibility, light must be reflected and focused to concentrate it down the road, but a diffuse light source with a diameter of one or two centimeters cannot be efficiently reflected or focused. There is then a need for a small diameter, high intensity, neon stop lamp.

Vehicle tail lamps commonly include red stop lamps, and a separate amber signal lamps. The SAE (Society of Automotive Engineers) has determined a particular amber and a particular red that are preferred for signal, stop, and warning illumination. These values are usually achieved with a tungsten filament lamp whose white light is filtered to provide the proper color. Tungsten lamps are not efficient when operated in this manner. Tungsten lamps have limited lives, and relatively slow turn on times. Tungsten lamps also become dimmer as they age. Tungsten lamps do however provide an intense source that can be reflected and focused.

Typical neon sign lamps having a mercury component, are too orange to satisfy the SAE requirement, so there is a need for a neon lamp whose color meets the SAE chromaticity requirements. Typical neon and other gas discharge lamps include mercury for starting, but these mercury dosed, neon lamps are also affected by cold. There is then a need for a mercury free neon lamp that meets SAE color requirements.

Some rare gases, argon, xenon, and krypton are known to emit ultraviolet light so as to stimulate a phosphor. Neon has a higher first energy band than other rare gases, so when the other rare gases, in concentrations higher than about one percent, are mixed with neon, the spectral output is substantially the result of the other, more easily emitting gases. Nonetheless, neon is used in such mixtures, usually to inhibit sputtering of the electrode.

Two separate lamp housings are used for the red and amber vehicle lamps, even though the amber signal lamp is normally not on most of the time. It would be useful if the one lamp housing could contain both the red and amber lamps.

Examples of the prior art are shown in the following U.S. patents:

U.S. Pat. No. 2,123,709 issued to L. J. Bristow et al on Jul. 12, 1938 for a Therapeutic Light Ray Apparatus shows narrow, folded over neon tube for therapeutically probing body cavities.

U.S. Pat. No. 2,152,999 issued to C. J. Milner for Gaseous Electric Discharge Lamp Device shows a lamp with 1 to 10 millimeters of neon pressure in an inner capsule along with cadmium in the fill. An outer silver layer reflects heat and visible light back into the inner capsule. The emitted ultraviolet light excites a phosphor to visible light emission. The power source is identified as an alternating current source, but is not specified further.

U.S. Pat. No. 2,421,571 issued to W. E. Leyson for Fluorescent Glow Lamp on Jul. 25, 1945 shows a glow lamp with a neon pressure of about 35 millimeter's pressure. The fill is 95 to 99% neon, and the rest krypton. Alternatively a mixture of 20 to 30 percent krypton and the rest argon is used. A variety of phosphors are used on the inner wall to produce visible light in different colors.

U.S. Pat. No. 2,874,324 issued to G. F. Klepp et al on Feb. 17, 1959 for Electric Gaseous Discharge Tubes shows a neon discharge device having a pressure of about 25 millimeters of mercury. By choosing the envelope size and lamp pressure, the voltage regulation of the device can be optimized to offset temperature induced response variations in the device.

U.S. Pat. No. 3,536,945 issued to C. D. Skirvin for Luminescent Gas Tube Including a Gas Permeated Phosphor Coating shows a neon and krypton gas filled lamp. No mercury is used in most examples. A phosphor is used to convert ultraviolet light to visible light. The gas combination is driven by an alternating current with a 23 kilohertz frequency. The gas combination enables the neon to act as a starter, while the krypton radiates at the steady state frequencies of excitation. The claim specifically states that neon and krypton alone do not produce ultraviolet light, and therefore the two must be combined. Other gas mixtures are used, all at pressures of from about 5 to 10 millimeters mercury.

U.S. Pat. No. 3,778,662 issued to P. D. Johnson for High Intensity fluorescent Lamp Radiating Ionic Radiation within The Range of 1,600–2,300 A.U. on Dec. 11, 1973 shows a fluorescent lamp using a rare gas and vaporizable fill.

U.S. Pat. No. 4,039,889 issued to Egon Vicai for Blue-White Glow Lamp on Aug. 2, 1977 shows a glow lap with from 1 to 15 percent xenon and 85 to 99 percent neon. A phosphor is coated on the inside of the envelope. The fill pressure is from about 50 to 112 Torr. The lamp is operated at about 40 to 70 volts direct current.

U.S. Pat. No. 4,196,374 issued to Harald Witting for Compact Fluorescent Lamp and Method of Making on Apr. 1, 1980 shows a compact fluorescent lamp using a "high percentage of neon" as a gas fill. The specification is generally directed to the glass shaping and manufacture, and is silent as to mercury. It is not clear whether mercury is included or not.

U.S. Pat. No. 4,461,981 issued to Saikatsu for Low Pressure Inert Gas Discharge Device shows a neon lamp at a pressure of less than 15 Torr, operated at more than 5 kHz. There is no phosphor used in the lamp.

U.S. Pat. No. 4,792,727 issued to Valery A. Godyak on Dec. 20, 1988 for a System and Method for Operating a Discharge Lamp to Obtain Positive Volt-Ampere Characteristic shows a gas discharge lamp operated with a base electron heating current, and an additional pulsed ionization current occurring faster than the diffusion time of the gas, said to be typically about 1 microsecond. A driving wave with a frequency of 3333 Hertz and a pulse width of 1 microsecond is suggested. A lamp is operated at 264 milliamps.

U.S. Pat. No. 4,882,520 issued to Tsunekawa for Rare Gas Arc Lamp having Hot Cathode on Nov. 2, 1989 shows a 6 millimeter inside tube diameter tube coated with a phosphor. The tube is filled with xenon from 20 to 200 Torr. The electrodes are hot cathode types. Neon is suggested as an alternative fill gas. The patent does not disclose cold electrode operation, nor is there any consideration of pulsed mode operation.

U.S. Pat. No. 4,914,347 issued to Osawa for Hot Cathode Discharge Fluorescent Lamp Filled with Low Pressure Rare Gas shows a narrow tube filled with a mixture of xenon and neon. A Hot cathode and a fluorescent coating are used. The pressure is less than 10 Torr. Including neon was found to help preserve the phosphor coating.

U.S. Pat. No. 4,926,095 issued to Shinoda for Three Component Gas Mixture for Fluorescent Gas Discharge Color Display Panel shows a flat panel display using xenon, neon and argon as a gas fill to stimulate phosphors on a panel display.

U.S. Pat. No. 5,034,661 issued to Sakurai for Rare Gas Discharge Fluorescent Lamp Device on Jul. 23, 1991 shows a rare gas, fluorescent lamp with a pulsed power source. The pulsing is from 4 to 200 kHz. The lamp pressure is from 10 to 200 Torr. The gas fill is a rare gas, but xenon, and krypton are the ones mentioned.

U.S. Pat. No. 5,072,155 issued to Takehiko Sakurai et al. on Dec. 10, 1992 for Rare Gas Discharge Fluorescent Lamp Device discloses a copying machine lamp with high brightness and efficiency. Sakuria suggests a xenon, argon, or krypton gas filled lamp, the use of a pulsed power supply where the pulse period is less than 150 microseconds, and the cycle period is greater than 5% of the pulse to avoid sputtering deterioration of the electrodes, and less than 70% of the pulse period to maximize light output for energy input. The gases emit ultraviolet light that stimulates a fluorescent coating to produce visible light.

U.S. Pat. No. 5,043,627 issued to L. Fox for High-Frequency Fluorescent Lamp shows a rare gas lamp with a phosphor coating. The lamp is driven by two cold cathodes operated at high frequency (10 to 50 kHz) radiators. The preferred gas fill is argon, but others are mentioned.

Canadian Patent Application 2092383 for Low Pressure Discharge Lamp and Luminare Provided with Such a Lamp by Bauke J. Roelevink et al and assigned to Philips Electronics N.V. shows a tubular glass vessel filled with a rare gas. Where mercury or xenon are present, a fluorescent coating may be applied. The lamp inside diameter is from 1.5 to 7 millimeters. These lamps are described as filled with various rare gases and rare gas and mercury fills. Pressures used ranged from 30 to 160 millibar (39.9 Torr to 213.3 Torr), depending on the fill type. Phosphors were used to coat some of the mercury or xenon containing lamps, and neon was used at a pressure of 15 millibar (19.99 Torr). No neon lamp is actually disclosed with a phosphor coating, nor is neon used at a pressure above 19.99 Torr. In general, Roelevink concerns a seal structure using a metal tube sealed through the envelope to a second glass vessel, presumably to thermally separate the final seal section.

Disclosure of the Invention

A neon lamp that may generate amber light or red light may be operated the neon discharge lamp has an enclosed, substantially pure neon fill with a pressure not less than 20 Torr, the lamp having a phosphor that is responsive to radiation by neon stimulated to a particular energy level, the phosphor being positioned to be within responsive range of the neon emission comprising supplying electric energy with a first energy pattern to cause the neon fill to emit light in a first wavelength region with a first chromaticity, and causing the neon gas additionally to stimulate the phosphor to emit light in a second wavelength region with a second chromaticity, and combining the first chromaticity light and the second chromaticity light to give a light with a third chromaticity.

BRIEF OF THE DRAWINGS

FIGS. 3, 4, 5, and 6 show cross sectional views, partially broken away, of aperture lamps with different lens structures.

Figure 7:
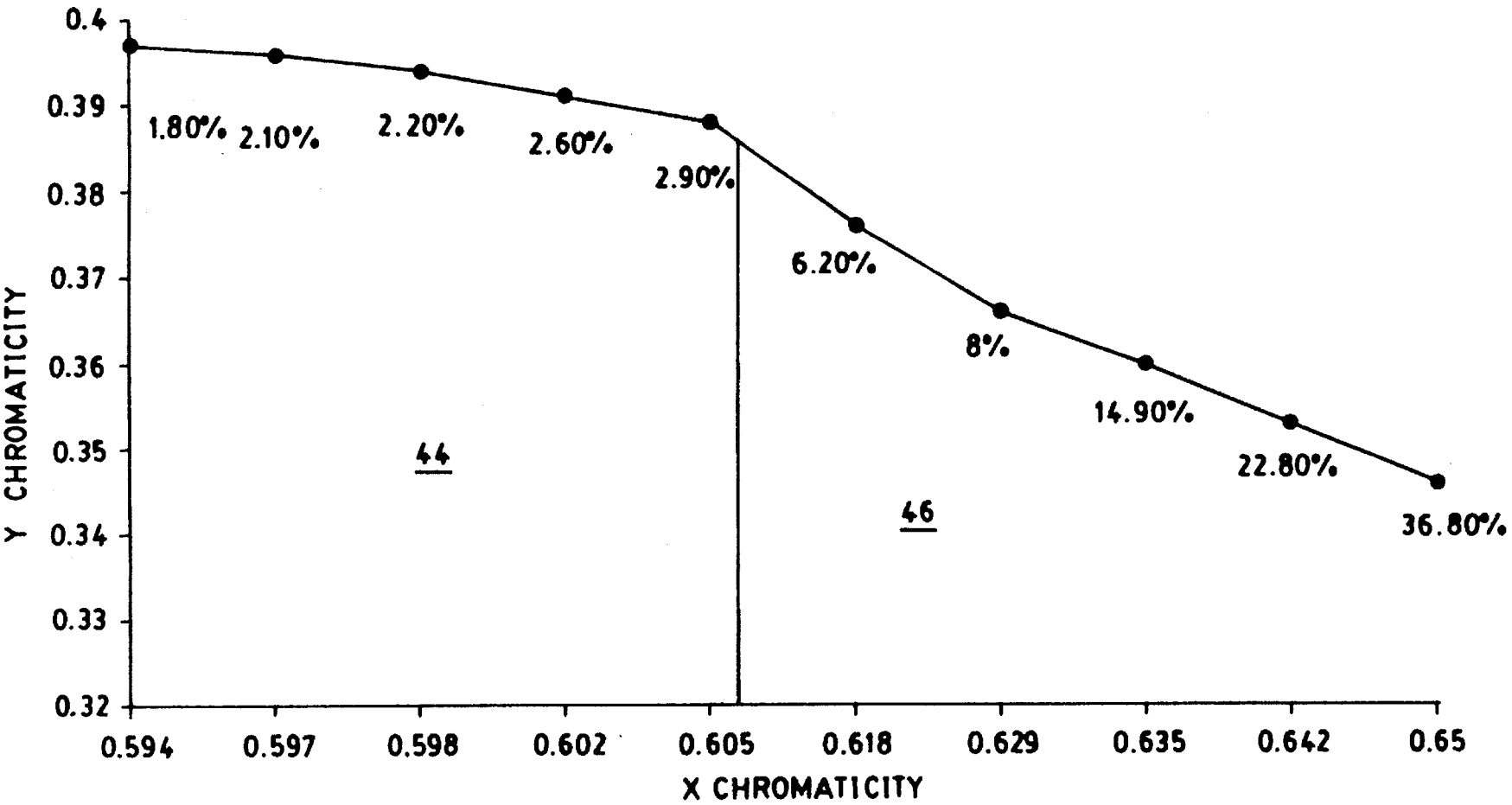

FIG. 7 shows color coordinates for the light output for a lamp operated at different duty cycles.

BEST MODE FOR CARRYING OUT THE INVENTION

Figure 1:
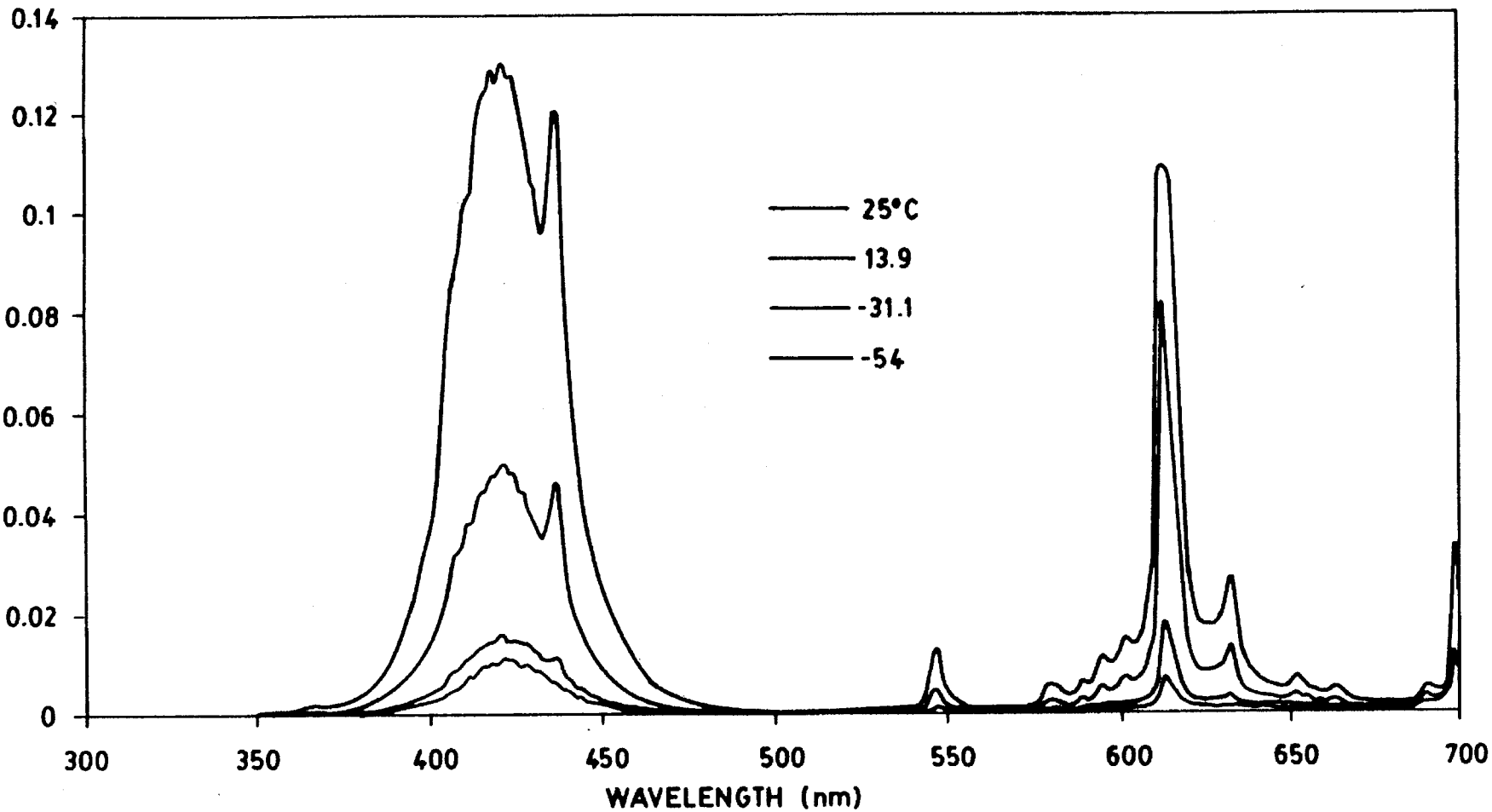
FIG. 1 shows the lumen output of a fluorescent lamp operated at different temperatures (prior art).
Figure 2:
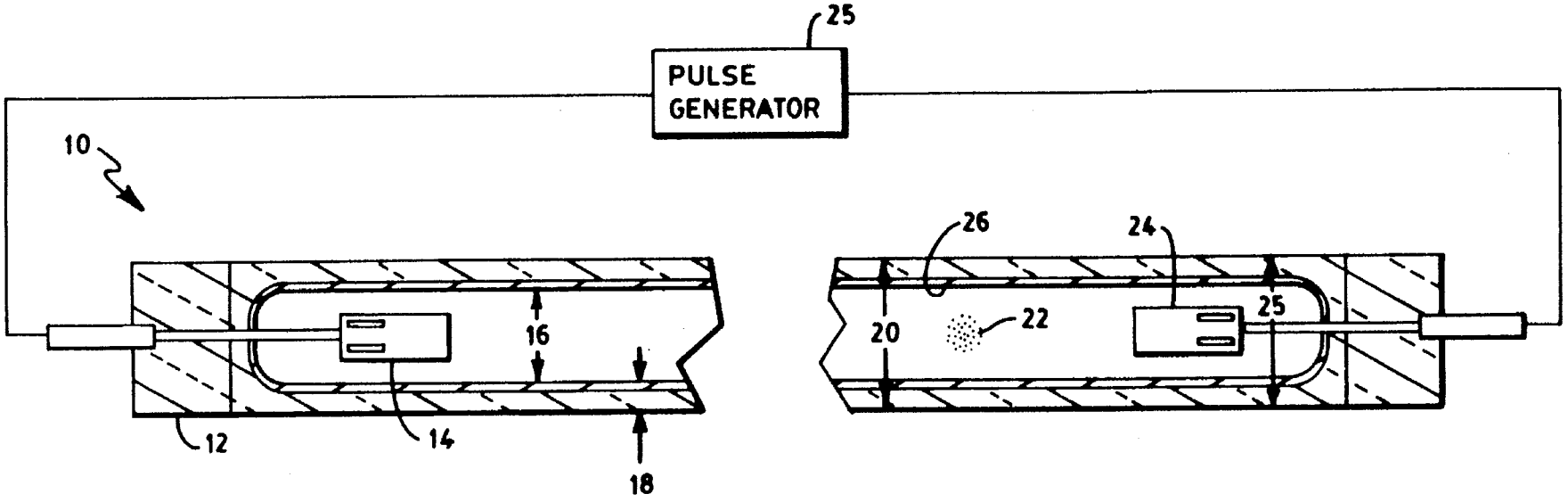
FIG. 2 shows a view, partially broken away of a preferred embodiment of a neon vehicle stop lamp operated by a pulse generator.

FIG. 2 shows a preferred embodiment of a neon fluorescent lamp, partially broken away. The neon stop lamp 10 for a vehicle is assembled from a tubular envelope 12, a first electrode 14, a neon gas fill 22, a second electrode 24, and a phosphor coating 26. The lamp is operated by a pulse generator 25.

The tubular envelope 12 may be made out of hard glass or quartz to have the general form of an elongated tube. The selection of the envelope material is important. The preferred glass does not devitrify, or outgas at the temperature of operation, and also substantially blocks the loss of neon. One suitable glass is an alumina silicate glass, a "hard glass," available from Corning Glass Works, and known as type 1724. Applicants have found that the 1724 hard glass nearly stops all neon loss. The 1724 glass may be baked at 900 degrees Celsius to drive out water and hydrocarbons. The hot bake out improves the cleanliness that helps standardize the color produced, and improves lamp life.

Common neon sign lamps use low pressure (less than 10 Torr), and produce low intensity discharges with low brightness. The envelope tubes are made from lead, or lime glasses that are easily formed into the curved text or figures making up the desired sign. The bent tubes are then filled and sealed. These glasses if operated at the higher temperatures of a more intense discharge release the lead, or other chemical species of the glass into the envelope. The glass is then devitrified, or stained, or the gas chemistry is changed resulting in a lamp color change. Using pure quartz is not fully acceptable either, since pure quartz has a crystal structure that allows neon to penetrate. Neon loss from the enclosed volume depends on the lamp temperature, and gas pressure, so for a higher pressure lamp, more neon is lost, resulting in a greater pressure and color change. There are additional optical and electrical changes that occur as the neon loss increases.

The envelope 12's inside diameter 16 may vary from 2.0 to 10.0 millimeters, with the preferred inside diameter 16 being about 3.0 to 5.0 millimeters. Lamps work marginally well at 9 or 10 millimeters inside diameter. Better results occur at 5 millimeters, and 3 millimeters appears to be the best inside diameter. The preferred envelope wall thickness 18 may vary from 1.0 to 3.0 millimeters with a preferred wall thickness 18 of about 1.0 millimeter. The outside diameter 26 then may vary from 4.0 millimeters to 16.0 millimeters with a preferred outside diameter 26 of 5.0 to 7.0 millimeters. Tubular envelopes have been made with overall lengths from 12.7 centimeters to 127 centimeters (5 to 50 inches). The overall length is thought to be a matter of designer choice.

At one end of the tubular envelope 12 is a first sealed end. The first sealed end entrains the first electrode 14. The preferred first sealed end is a press seal capturing the first electrode 14 in the hard glass envelope. Positioned at the opposite end of the tubular envelope 12 is a second sealed end. The second sealed end may be formed to have substantially the same structure as the first seal, capturing a similarly formed second electrode 24.

Electrode efficiency, and electrode durability are important to overall lamp performance. The preferred electrode is a cold cathode type with a material design that is expected to operate at a high temperature for a long lamp life. It is understood that hot cathode or electrodeless lamps may be made to operate using the method of operation. A molybdenum rod type electrode may be formed to project into the enclosed envelope volume, with a cup positioned and supported around the inner end of the electrode rod. The cup may be formed from nickel rolled in the shape of a cylinder. The Applicants' prefer a tubular metal section. The cup may be attached by crimping or welding the metal tube to the electrode rod.

The region between the electrode tip and the inner wall of the cup may be coated or filled with an electrically conductive material that preferably has a lower work function than does the cup. The fill material is preferably an emitter composition having a low work function, and may also be a getter. The preferred emitter is an alumina and zirconium getter material, known as Sylvania 8488 that is spun deposited and baked on to provide an even coating. The cup surrounds the emitter tip, and extends slightly farther, perhaps 2.0 millimeters, into the tubular envelope than the inner most part of the electrode rod, and the emitter material extend. Emitter material, or electrode material that might sputter from the emitter tip tends to be contained in the extended cup.

The preferred rare gas fill 22 is substantially pure, research quality neon. The Applicants have found that purity of the neon fill, and cleanliness of the lamp are important in achieving proper lamp color. Similarly, no mercury is used in the lamp. While mercury reduces the necessary starting voltage in a discharge lamp, mercury also adds a large amount of blue, and ultraviolet light to the output spectrum. Mercury based lamps are also difficult to start in cold environments, an undesirable feature for a vehicle lamp. While other gases, such as argon, helium, krypton, nitrogen, radon, xenon and combinations thereof, could be included in the lamp, in minor concentrations (substantially pure). Otherwise these gases quickly affect the starting conditions, operating conditions and the output color. In general these other gases have lower energy bands than neon, and therefore even in small quantities, tend to either dominate the emission results, or quench the neon's production of ultraviolet and visible light. Pure, or substantially pure neon is then the preferred lamp fill.

The gas fill 22 pressure affects the color output of the lamp. Increasing pressure shortens the time between atomic collisions, and thereby shifts the population of emitting neon species to a deeper red. By adjusting the pressure, one can then affect the lamp color. At pressures below 10 Torr, the chromaticity is outside the SAE red range. At 70 Torr the neon gives an SAE acceptable red with chromaticity figures of (0.662, 0.326). At 220 Torr, the color still meets the SAE requirements, but has shifted to a deeper red with coordinates of (0.670, 0.324). With decreasing pressure the emitted light tends to be orange.

The neon gas fill 22 may have a preferred pressure from 20 Torr to 220 Torr. At pressures of 10 Torr or less, the electrodes tend to sputter, discoloring the lamp, reducing functional output intensity, and threatening to crack the lamp by interacting the sputtered metal with the envelope wall. At pressures of 220 Torr or more, the ballast must provide a stronger electric field to move the electrons through the neon, and this is less economical. Lamps above 300 Torr of neon are felt to be less practical due to the increasing hardware and operating expense. The effect of pressure depends in part on lamp length (arc gap). The preferred pressure for a 30 centimeter (12 inch) lamp is about 100 Torr.

The lamp envelope is further coated with a phosphor 26 responsive to the ultraviolet radiation lines of neon. Numerous phosphors are known, and normally they are adhered to the inside surface of the lamp envelope. They may be attached to other surfaces formed in the interior of the envelope. Almost any phosphorescent mineral held in a binder is thought to be potentially useful. The preferred phosphor 26 for amber color, has an alumina binder and includes yttrium alumina ceria. Applicants use Sylvania type 251 phosphor, whose composition includes $Y_3{:}A_{15}O_{12}{:}Ce$. Applicants have also found willemite (zinc orthosilicate) phosphors to work, but these are less preferred.

The lamp is operated by a pulse generator 25 to give the neon red color, or the combined phosphor and neon colors. The red mode may be accomplished by delivering either direct current or continuous wave alternating current power. To activate the phosphor and form the prescribed color through the mixing of the neon and phosphor emissions, the power is switched to a pulse-mode. The Applicants have used laboratory type equipment to generate the pulses described here.

During pulse-mode operation the preferred electronic states of neon are the 3P electronic orbitals which decay to the 3S level, producing two of the important red emission lines at about 638 and 703 nanometers. The 3S level is the lowest excited level of the neutral neon atom and the decay of electronic states from this level produce emission in the vacuum ultraviolet around 74 nanometers in wavelength. There are four arrangements or configurations for an available electron with sufficient energy to be positioned in the 3S position or orbital. Two of these configurations permit energy release by light radiation. The other two configurations are "frozen" forming metastable conditions of the neon atom. During gas collisions or interactions the two metastable conditions may be perturbed permitting release of the energy either through light radiation or by inelastic means such as an excitation of phosphor sites on the coating. In this way, the metastable states of neon can excite the phosphor by either ultraviolet light emission or collisional contact with the phosphor surface.

In either case, a short current pulse discharge is necessary. A pulse of less than 3 microseconds is recommended, with pulses of from 1 to 2 microseconds or less being preferred. Ideally, in one instant, all the neon could be raised to the 3S and 3P states, but it is difficult to generate electron pulses with short durations (less than 1 microsecond) that still have sufficient average energy. As the length of the pulse increases, the 3S and 3P levels become less favored with respect to higher orbitals. The longer the pulse becomes after 2 or 3 microseconds, the more likely other neon orbitals will become populated, and the less likely the 3S and 3P orbitals will be populated Exciting the neon to the upper levels is undesirable because, for the most part, the available subsequent decay channels are not in the visible red region but occur in the near infrared. These higher neon levels may not even decay in a "cascade" fashion to the 3S level which is needed to produce the ultraviolet light and metastable levels. As pulse duration increases, collisions between atoms, ions and electrons increase, providing additional energy loss mechanisms that may not involve emission in the visible, for example in the infrared. Applicants have detected only minimal amounts of ultraviolet light with pulses on for 25 microseconds.

Once the neon becomes populated in the 3S and 3P orbitals it is necessary to allow the neon to decay spontaneously, emitting the ultraviolet radiation. By continuing the electric field, the neon can be excited to additional, higher orbitals, leading to emissions with a wider range of wavelengths. The off period therefore preferably goes to zero voltage. The off period should be long enough to allow the neon to decay (emit the ultraviolet radiation). Returning to the pulse on state before all the neon has decayed catches some neon atoms in an excited state, and drives them up into higher orbital states. The shorter the off period, the more atoms are caught, and the greater the spectral shift is away from the ultraviolet region. Waiting for all of the neon to decay gives a spectra that has the most concentrated ultraviolet. However, returning to the pulse on state only after the decay of all the neon is inefficient, and only reduces the lamp's total output. Also, the longer the off period, the more difficult it is for the ballast to re-ionize the neon, and provide high power. There is then an efficiency balance to be struck. The off period at a minimum should be long enough to allow some of the neon to decay. More preferably, the off period should be equal to or longer than the average decay period of neon from the 3P and 3S orbitals (lifetime). In practice, the off period should be on the order of the bulk decay time of the neon discharge, but need not be longer than the period for complete decay from the same states for all the neon. Applicants have found that an off period of less than 5.0 microseconds is ineffective in producing ultraviolet light, whereas an off period of greater than or equal to 20 microseconds is effective in producing ultraviolet light.

By adjusting the on period, or the off period, the ultraviolet output of the lamp can be increased or decreased. The effect of adjusting the pulse duration on the excitation of the phosphor is exploited to produce a variable color light source. Color can be varied by shifting the amounts of the phosphor emission and the underlying neon emission. In a completely coated tube, the neon emission that filters through the phosphor coating, and the excited phosphor emission, mix to give the observed color. Some reduction in the neon emission strength occurs, but for optics involving reflector applicators or concentrators a uniform intensity profile of the source is important. The gas pressure, pulse width, and repetition rate may be adjusted to optimize the contributions from the neon and phosphor emissions.

In some situations it may even be desirable to change colors by gradually reducing the phosphor contribution and enhancing the residual neon emission. This can be accomplished by gradually increasing the duty cycle of the pulsed power out to a steady direct current AC or DC condition. The pulse on, or pulse off periods may be adjusted. Another method of operation is to provide different pulse types in the series of pulses. Pulses of one type are directed at simulating the phosphor along with the visible neon emission. These may be alternated with pulses of a second type directed at stimulating just the visible neon emission. Since the pulses occur rapidly, the eye averages the lamp output. The ratio of the numbers of the two (or more) pulse types in any short period of time may be adjusted in the input stream to shift the lamp color.

Figure 3:
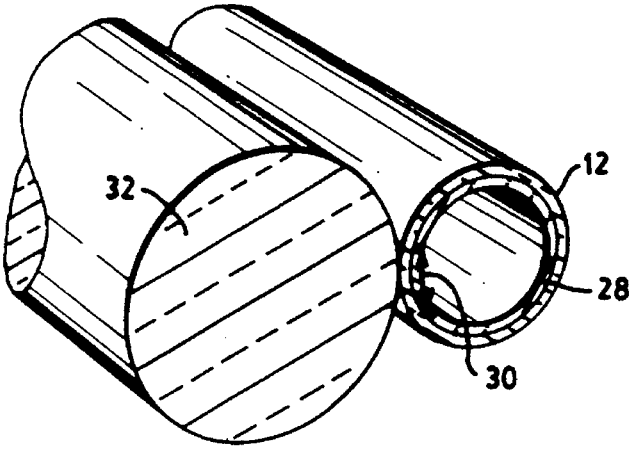

For some automotive conditions it is desirable to have a rapid change in color, for example to change from the red tail and stop function immediately to the amber turn function. Such a two color lamp may be constructed as a fully coated phosphor lamp, allowing some of the neon red to pass through the phosphor coating. Preferably, the lamp is formed as a phosphor coated tube with an uncoated strip running the length of the lamp forming an aperture. An aperture lamp may also include a reflective undercoating to enhance aperture intensity. FIG. 3 shows in cross section an aperture lamp, partially broken away. The aperture lamp may otherwise be similarly formed as the fully coated tube as shown in FIG. 2, with an envelope 12 and a partial coating 28 axially extending with a gap 30 formed in the phosphor coating, creating an aperture. The aperture through the phosphor may be formed be scraping away a section of the original phosphor coating to leave a clear window to view the inside of the lamp. The preferred aperture for the 5 millimeter diameter lamp is about 1 millimeter wide, or about thirty-five to forty-five degrees of arc from the tube center. The phosphor generated light, emitted most brightly from the remaining, inward facing phosphor surface, and the arc generated light may then mix and pass directly through the aperture. The aperture passing light is then not filtered through the phosphor coating before reaching the exterior. The result is a much brighter source when viewed through the aperture, yet the neon and phosphor spectra are still combined in viewing through the aperture.

Figure 4:
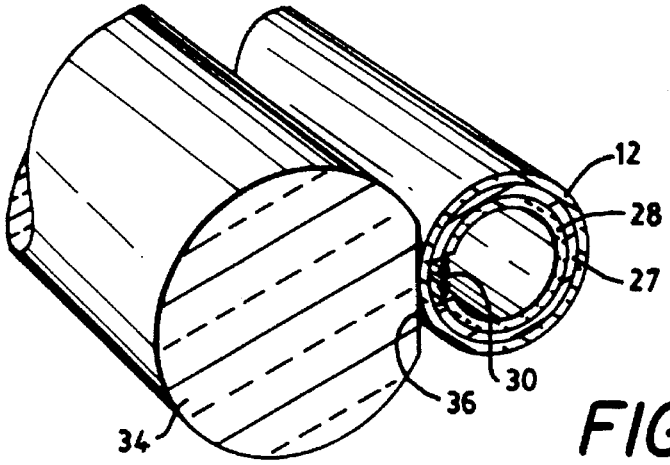

FIG. 4 additionally shows an aperture lamp with a reflective coating 27 positioned between the envelope 12 and the phosphor coating 28. The reflective coating 27 returns the light to the envelope 12 cavity, allowing the light to escape substantially only through the aperture 30. The preferred reflective coating is alumina (aluminum oxide), and it is generally exactly coextensive with the phosphor coating 28. The reflective coating 27 and the phosphor coating 28 may be applied as fluid slurries, dried and baked in place by commonly used techniques.

Figure 5:
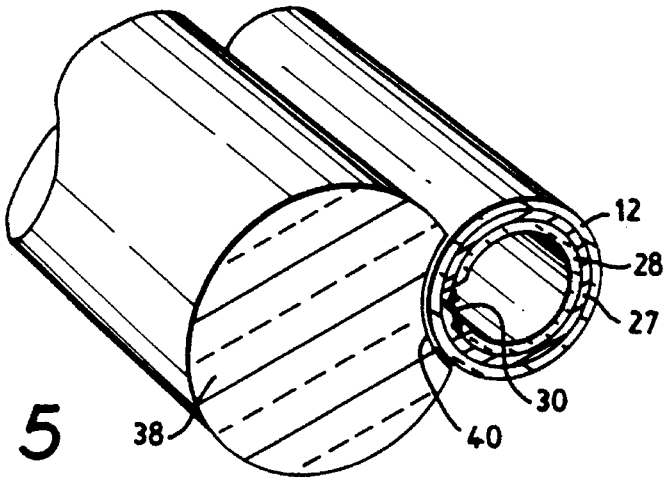
Figure 6:
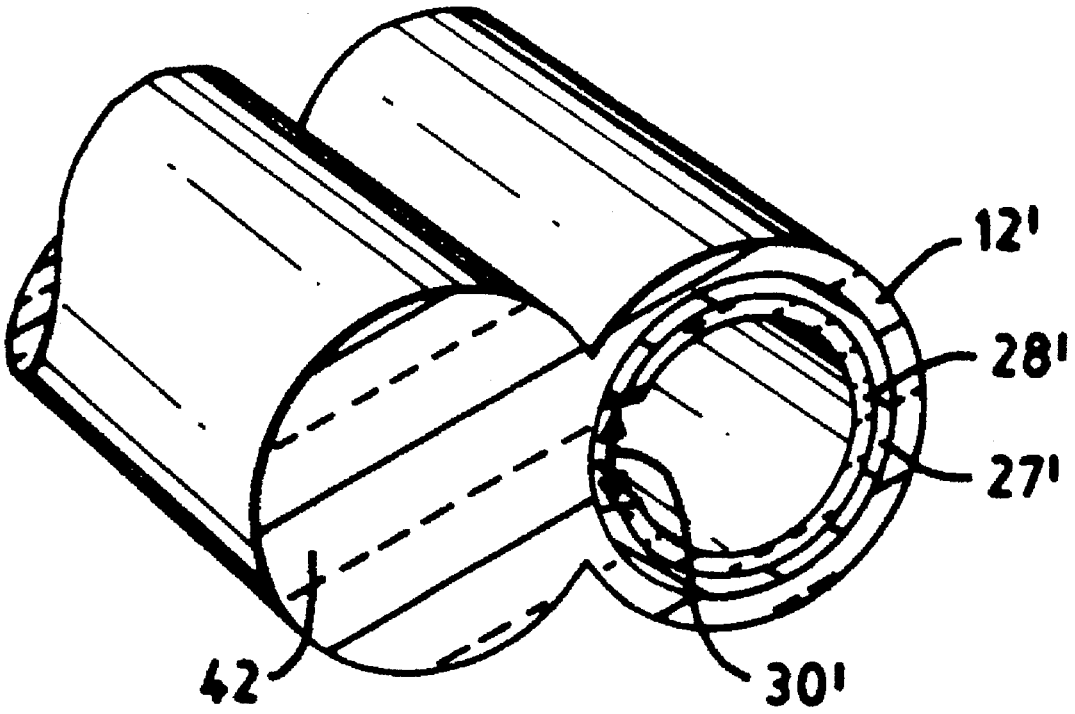

FIGS. 3, 4, 5, and 6 show alternative aperture lamps with lens positioned in front of the aperture. In FIGS. 3, 4, and 5, the neon lamp is in each case is formed with the envelope 12, a reflective coating 27 (FIG. 4, 5, and 6), a phosphor coating 28 (FIGS. 3, 4, 5 and 6) having an axially extending gap 30 in the reflective and phosphor coatings of about 35 to 45 degrees. In FIG. 3 the neon lamp abutted to a solid circular glass rod 32 with about twice the diameter of the neon lamp tube. The rod 32 is positioned in front of the gap 30 forming the aperture to abut the lamp tube along the centerline of the aperture. The circular rod is an inexpensive, yet reasonably effective lens to focus the emerging light from the aperture more in the plane containing the lamp axis and lens axis. In FIG. 4, a similar solid circular rod 34 is cut, or polished axially to present a planar face 36 to the aperture. The planar face 36 has about the same width as the aperture. The rod 34 with the flat face 36 is more expensive to make, but is provides a somewhat more efficient lens. FIG. 5 shows a similar rod 38 with a hollowed out face 40, so the rod 38 and lamp may be fitted in flush abutment along the face 40. FIG. 6 shows a single piece lamp tube with a lens formed as part of the lamp envelope wall. The single piece lamp tube has a similarly sized and shaped envelope section 12' and a similar sized and shaped reflective coating 27' and phosphor coating 28' with a similarly formed gap 30'. The envelope is further formed to include a solid rod like section 42 extending way from the region of the aperture to form an integral lens section of the envelope wall 12'. The integral lens 42 is believe to be the most expensive to make, and provide the most efficient lens. In each case, the axially extending lens 32, 34, 38 or 42, is positioned to run parallel with the length of the aperture, gap 30. The particular chosen lens shape depends on the field to be illuminated, and such lens selection is thought to be within the skill of designers. Applicants prefer a circular section lens, as they are inexpensive, and effectively direct light in the direction from the lamp axis through the aperture. In either case the lens focuses the emitted light, thereby directing relatively more light on for example, a road.

Neon has two vacuum ultraviolet radiation lines at about 74 nanometers (73.6 and 74.3 nanometer). Normally this radiation is believed to be re-absorbed by nearby neon. In a relatively thin lamp, a portion of this radiation occurs adjacent to the phosphor coating and can be absorbed by the phosphor. An alternative mechanism of explaining the Applicants' discovery, is that the neon atoms under proper stimulation can be placed in a metastable condition that is released on contact with the phosphor, or the wall. The phosphor receives energy from the excited neon, and thereafter emits light in the visible range. Type 251 phosphor is responsive to the 74 nanometer neon radiation, and emits a green colored light, that in combination with some of the neon red light, produces an amber light. By adjusting the amount of the 74 nanometer radiation produced, as against the amount of neon red, one can adjust the color of the combined light.

Applicants also found that the type 251 and willemite phosphors were not responsive when a 60 kHz sine wave stimulation was applied to the enclosed neon. The neon of itself was responsive, giving a red color, but the neon did not stimulate the phosphor to emit. The same lamp could then be operated under differing electrical conditions to give either amber light (phosphor green plus neon red), or just neon red light.

The operating lamp voltage is chosen according to the lamp length. The disclosed neon lamps are generally operated at 40 to 70 volts RMS per centimeter of electrode separation, and at about 0.5 to 5.0 milliamps RMS per centimeter of electrode separation. The best value is thought to be about 2.2 milliamps RMS per centimeter of electrode separation. The lamp wattage may range from about 5.0 to about 50.0 watts, with the longer length lamps having the greater wattages.

The method of lamp operation is also relevant to the efficiency of the lamp and the chromaticity of the emitted light. By varying the pulse width, the lamp color due to the rare gas, such as neon emission, can be shifted from a reddish orange to a deep red. It is therefore more efficient both for candela and SAE red color production to apply just the power that excites the desired emission species, and to do so only for so long as is needed to bring the neon atoms up to the best level of excitation (3S, and 3P states). Energy may then be saved in each cycle, as the properly excited neon atoms are left to collide and emit the desired phosphor stimulating wavelength or the desired visible light frequency.

The Applicants have also found that to enhance the phosphor generated component of the visible light, the pulse voltage should substantially drop to zero between pulses. Where there is a lingering voltage between pulses, the neon continues to be stimulated to emit relatively more red light, and relatively less ultraviolet light, or metastable to phosphor collisions. This decreases the color component produced by the phosphor. As a result, phosphor coated neon lamp can be operated in a pulsed mode, such as 20 kHz, with a duty cycle of less than three percent, preferably with a zero voltage point. It is understood that pulsed electrical energy can refer to pulsed direct current, chopped continuous wave current, switched high frequency power, or a variety of other forms. It is important only that the pulse have an electric field pulse (on period) with a rise sufficient to stimulate neon atoms into the 3S or 3P orbitals. The pulse should then be followed with an off period, sufficient to allow at least some of the excited neon atoms to decay. The preferred values being a 1 microsecond pulse width at a frequency greater than the emission decay time of neon at about 74 nanometer, with a zero voltage point. The lamp can then be operated to produce an amber colored light meeting color coordinate requirements set out by the SAE, and ECE for automotive lighting. For a lamp intended to have the combined phosphor and neon color, the pulse width should be from 1 to 50 microseconds. The pulse frequency should be in the range sufficient to stimulate the ultraviolet radiation, or metastable condition that stimulates the chosen phosphor.

FIG. 7 shows color coordinates for the light output for a neon lamp operated at different duty cycles. The lamp was a 38.1 cm (15 inch), 100 Torr, pure neon, lamp operated at 20 kHz. When the lamp was operated generally below 3 percent duty cycle, region 44, the output color was amber. When the same lamp was operated at generally above 3 percent duty cycle, region 46, the color was reddish orange or red. Longer duty cycles gave redder light. The particular data is summarized in the following table:

| Percent Duty Cycle | X Chromaticity | Y Chromaticity |
|---|---|---|
| 1.8 | 0.594 | 0.397 |
| 2.1 | 0.597 | 0.396 |
| 2.2 | 0.598 | 0.394 |
| 2.6 | 0.602 | 0.391 |
| 2.9 | 0.605 | 0.386 |
| 6.2 | 0.618 | 0.376 |

-continued

| Percent Duty Cycle | X Chromaticity | Y Chromaticity |
|---|---|---|
| 8.0 | 0.629 | 0.366 |
| 14.9 | 0.635 | 0.360 |
| 22.8 | 0.642 | 0.353 |
| 36.8 | 0.650 | 0.346 |

The same lamp can then be operated in a different pulsed mode, or in a sine wave condition, not pulsed, to produce red light. By changing from one duty cycle (or pulse width) condition to another the same lamp can then be switched from one color to another.

The operating voltage may range from 1000 to 10,000 volts or higher depending on the lamp size. Similarly currents may range from 20 milliamps to 1 amp.

In summary the best pressure to meet the SAE red chromaticity is from 20 to 220 Torr of pure neon, depending in part on the lamp length. The best pressure for electrical efficiency is as small as possible, while the best pressure for sputtering control is greater than 50 Torr and more preferably 70 Torr to 130 Torr. The best frequency for candela efficiency is from 12 to 17 kHz for a 25 centimeter (10 inch) long lamp. The best duty cycle for amber is less than 3 percent at 20 kHz, while the duty cycle needed for an SAE red is more than 50 percent at 20 kHz. It is understood that a sufficient amount of energy is necessary to be applied for a chosen duty cycle, that a zero voltage crossing is preferred, and that a sharp crest in the applied pulse is preferred. Applicants prefer a crest factor greater than 1.41. They have found crest factors of 4 to 8 to be effective, and believe that the higher the crest factor the better the results for phosphor stimulation. Applicants currently also believe higher frequencies may be important in longer length lamps. While the best practical system frequency is just above the limit of most human hearing or about 20 kHz. The best pulse width for candela efficiency is below 20 microseconds.

In a working example some of the dimensions were approximately as follows: The tubular envelope was made of 1724 hard glass, and had a tubular wall with an overall length of 50 centimeters, an inside diameter of 3.0 millimeters, a wall thickness of 1.0 millimeters and an outside diameter of 5.0. Lamps with 5.0 millimeter inside diameters and 7.0 millimeter outside diameters have also been made, and the slightly larger diameter is convenient for making the aperture. The electrodes were made of molybdenum shafts supporting crimped on nickel cups. Each nickel cup was coated with an alumina and zirconium getter material, known as Sylvania 8488. The molybdenum rod had a diameter of 0.508 millimeter (0.020 inch). The exterior end of the molybdenum rod was butt welded to a thicker (about 1.0 millimeter) outer rod. The inner end of the outer rod extended into the sealed tube about 2 or 3 millimeters. The thicker outer rod is more able to endure bending, than the thinner inner electrode support rod. The cup lip extended about 2.0 millimeters farther into the envelope than did the rod.

The inside surface of the envelope was coated with a yttrium, alumina, and ceria phosphor composition. The gas fill was pure neon, and had a pressure ranging from 20 to 220 Torr, preferably about 100 Torr. The lamp was operated at 12.7 watts, and it produced 11.43 candelas (0.9 candela per watt). The lamp light had an amber color meeting the SAE amber color requirements.

A lamp with a 5.0 millimeter inside diameter and 7.0 millimeter outer diameter with 100 Torr of pure neon was phosphor coated with the Sylvania 251 phosphor and operated (pulsed) at 18 kHz with a 4 percent duty cycle. The lamp produced 21.51 candelas, for 1.72 candelas per watt. The light had color coordinates of (0.607, 0.388). A similar lamp was made with an 1 or 2 millimeter aperture, and then operated in a similar fashion. The second lamp produced 45.82 candelas through the aperture at 3.71 candela per watt with color coordinates of (0.620, 0.380). The second lamp with an aperture emitted 213% as much light as the first. A third lamp was similarly made with an 1 or 2 millimeter aperture, and then operated in a similar fashion, using a glass rod lens to focus light toward the light detector. The third lamp produced 97.25 candelas through the aperture at 7.67 candelas per watt at color coordinates of (0.611, 0.383). The third lamp with an aperture and lens then emitted 451% as much light as the first lamp. While there have been shown and described what are at present considered to be the preferred embodiments of the invention, it will be apparent to those skilled in the art that various changes and modifications can be made herein without departing from the scope of the invention defined by the appended claims.

We claim:

1. A method of generating light with a discharge lamp having an enclosed, substantially pure neon fill with a pressure not less than 20 Torr, the lamp having an enclosed phosphor that is responsive to neon stimulated to a particular energy level, the method comprising: a) supplying to the neon gas, pulsed electric energy with an on period, followed an off period to thereby cause the neon to stimulate the phosphor to emit light in a first visible wavelength region with a first chromaticity, and additionally supplying electric energy to stimulate the neon to emit visible light in a second wavelength region with a second chromaticity, b) combining the first chromaticity light and the second chromaticity light to give a combined light with a third chromaticity.

2. The method in claim 1, wherein the on period of the pulsed electric energy is less than or equal to 25 microseconds.

3. The method in claim 2, wherein the on period is less than 10 microseconds.

4. The method in claim 2, wherein the on period is less than 2 microseconds.

5. The method in claim 1, wherein the off period of the pulsed electric energy is more than the average decay period of the neon discharge emission.

6. The method in claim 1 wherein the off period is equal to or greater than 5.0 microseconds.

7. The method in claim 1, wherein the off period is equal to or greater than 20 microseconds.

8. The method in claim 1, wherein the on period is less than 2 microseconds, and the off period is equal to or greater than 20 microseconds.

9. A method of generating light with different chromaticities with a discharge lamp having an enclosed, substantially pure neon fill with a pressure not less than 20 Torr, the lamp having an enclosed phosphor that is responsive to stimulation by neon in particular energy levels, the method comprising:

a) supplying to the neon gas, pulsed electric energy with an on period, followed an off period to thereby cause the neon to stimulate the phosphor to emit light in a first visible wavelength region with a first chromaticity, and additionally supplying electric energy to stimulate the neon to emit visible light in a second wavelength region with a second chromaticity, b) combining the first chromaticity light and the second chromaticity light to give a combined light with a third chromaticity; and c) adjusting the electric energy to shift between the conditions causing the neon to stimulate the phosphor, and the conditions causing the neon to emit visible light, to thereby adjust the amount of light produced with the first chromaticity, and the amount of light produced with the second chromaticity, thereby adjusting the chromaticity of the combined light with the third chromaticity.

10. The method in claim 9, wherein the on period is less than the maximum on time allowing stimulation of the phosphor, and the off period is adjusted from less than the minimal off time for stimulating the phosphor, to a time more than the minimal off time for stimulating the phosphor.

11. The method in claim 9, wherein the on period is less than 3 microseconds and the off period is adjusted from less than 20 microseconds to more than 20 microseconds.

12. The method in claim 11, wherein the on period is from 1 to 2 microseconds and the off period is adjusted from less than 20 microseconds to more than 20 microseconds.

13. The method in claim 9, wherein the off period is more than the average decay period of neon, and the on period is adjusted from less than 3 microseconds to more than 3 microseconds.

14. The method in claim 9, wherein the off period is equal to or greater than 5 microseconds, and the on period is adjusted from less than 2 microseconds to more than 2 microseconds.

15. The method in claim 9, wherein the off period is equal to or greater than 20 microseconds, and the on period is adjusted between less than 2 microseconds to more than 2 microseconds.

16. A method of generating light with a discharge lamp having an enclosed, substantially pure neon fill with a pressure not less than 20 Torr, the lamp having an enclosed phosphor that is responsive to ultraviolet light emission by neon, the method comprising:

a) supplying electric energy with a first energy pattern to cause the neon fill to emit ultraviolet light to stimulate the phosphor to emit light in a first wavelength region with a first chromaticity, and causing the neon gas additionally to emit light in a second wavelength region with a second chromaticity; and b) combining the first chromaticity light and the second chromaticity light to give a light with a third chromaticity.

17. A method of generating light with a lamp having an enclosed, mercury free, substantially neon fill, the lamp having an enclosed phosphor that is responsive to radiation by the neon from the 3S energy level, the method comprising:

a) supplying pulsed electric energy to the neon not at a rate from 1 to 50 kilohertz, and with a pulse width less than from 20 microseconds to thereby cause the neon to emit light predominantly in a first wavelength region with a first chromaticity, b) supplying electric energy to the neon that is both at a rate from 1 to 50 kilohertz, and with a pulse width of less than from 20 microseconds thereby causing the neon gas to stimulate the phosphor to emit light in a second wavelength region with a second chromaticity; and c) combining the first chromaticity light and the second chromaticity light to give a light with a third chromaticity.

18. A method of operating a lamp with an enclosed, mercury free, neon fill, the lamp having an enclosed phosphor that is responsive to the neon stimulated to a particular energy level, the method comprising:

a) in a first condition, supplying electric energy to cause the neon to emit visible light with a first chromaticity, b) in a second condition, supplying electric energy to cause the neon to emit visible light and emit ultraviolet light to stimulate the phosphor to emit additional visible light thereby providing in combination visible light with a second chromaticity; and c) switching between the first condition, and second condition to cause the lamp to switch from emitting light of the first chromaticity to light of the second chromaticity.

19. The method in claim 17, further including the step of adjusting the electrical input to alter the relative concentrations of the first wavelength and second wavelength light to thereby adjust the chromaticity of the combined light.

20. The method in claim 18, wherein the electric energy is pulsed, and has a first pulse type corresponding to the stimulation of the first wavelength light, and thereby the second wavelength light, and further having a second pulse type corresponding to the stimulation of the third wavelength type.

21. The method in claim 19, wherein the ratio of first pulse types to the second pulse types may be adjusted in the input signal to thereby adjust the relative concentrations of the second wavelength light and the third wavelength light in the combined light.

22. A method of operating a neon lamp comprising a glass defining an enclosed volume, a first electrode penetrating the glass envelope, a second electrode penetrating the glass envelope, a phosphor coating responsive to neon generated ultraviolet light, and a substantially pure neon fill positioned in the enclosed volume, comprising:

applying pulsed electrical energy between the first electrode and the second electrode through the enclosed neon fill, the pulses having a crest factor greater than 1.41, and an energy content not less than the energy needed to stimulate a neon atom from ground state to the 3S state and not greater than the energy need to stimulate a neon atom from ground state to more than the 3P state, and the pulses being separated in time by a period greater than the average decay time of neon discharge to there by produce ultraviolet light to stimulated the phosphor.

23. The method in claim 22, wherein the pulse width is less than 20 microseconds.

24. The method in claim 22, wherein the duty cycle is less than three percent.

25. The method in claim 22, wherein the frequency is from 1 to 50 kilohertz.

26. The method in claim 22, wherein the frequency is less than 20 kilohertz.

27. The method in claim 22, wherein the pulse width is from 1 to 2 microseconds.

28. The method in claim 22, wherein the pulse width is from 8 to 14 microseconds.

29. The method in claim 28, wherein the pulse width is from 10 to 12 microseconds.

30. The method in claim 22, wherein the duty cycle is less than three percent.

31. A method of operating a positive column neon rare gas discharge lamp having a gas fill including substantially pure neon and with no mercury, and an enclosed phosphor, the method comprising:

a) supplying pulses of direct current with a duty cycle from 0.5 to 3.0 percent, and b) at a frequency from 10 to 50 kilohertz.

32. A method of producing amber light by stimulating a first proportion of a neon volume to a predominantly 3S energy level in the presence of a green emitting phosphor sensitive to approximately 74 nanometer ultraviolet radiation, while simultaneously stimulating a second portion of the neon to emit neon red, whereby the red neon emission and the green phosphor emission are combined to form amber.

33. A method of producing amber light by stimulating a first proportion of a neon volume to a predominantly 3P energy level decaying to the 3S energy level in the presence of a green emitting phosphor sensitive to approximately 74 nanometer ultraviolet radiation, while simultaneously stimulating a second portion of the neon to emit neon red, whereby the red neon emission and the green phosphor emission are combined to form amber.

34. A neon lamp for producing amber light comprising a glass envelop defining an enclosed volume, a first electrode penetrating the glass envelope, a second electrode penetrating the glass envelope, the first electrode and the second electrode being sufficiently separated to form a positive column discharge therebetween, a phosphor coating responsive to neon generated ultraviolet light, and a substantially pure neon fill in the enclosed volume pressurized to 20 or more Torr.

35. The lamp in claim 22, wherein the envelope has in inside diameter less than or equal to nine millimeters.

36. The lamp in claim 23, wherein the envelope has in inside diameter less than or equal to seven millimeters.

37. The lamp in claim 24, wherein the envelope has in inside diameter less than or equal to five millimeters.

38. A rare gas discharge lamp comprising:

a) an envelope formed of a light transmissive material, the envelope having a wall defining an enclosed volume, and having a diameter, b) a first cold electrode extending from the exterior through the wall to be in contact with enclosed volume, c) a second cold electrode extending from the exterior through the wall to be in contact with enclosed volume, d) a substantially pure neon gas fill with no effective amount of mercury, and at most only minor other fill components, captured in the enclosed volume capable of providing a first wavelength light output on a first condition of electrical stimulation between the electrodes, e) a phosphor coating enclosed in the envelope, the phosphor being responsive to the first wavelength light to produce a second wavelength light in the visible range.

39. The lamp in claim 38, wherein the envelope has in inside diameter less than or equal to nine millimeters.

40. The lamp in claim 39, wherein the envelope has in inside diameter less than or equal to seven millimeters.

41. The lamp in claim 40, wherein the envelope has in inside diameter less than or equal to five millimeters.

42. The lamp in claim 38, wherein the phosphor is one including yttrium, alumina and ceria.

43. The lamp in claim 38, wherein the phosphor is one including willemite.

44. The lamp in claim 38, wherein there is a reflective coating adjacent the envelope wall, and the phosphor coating is positioned intermediate the reflective coating, and the neon.

45. The lamp of claim 44, wherein the phosphor includes type yttrium, alumina and ceria.

46. The lamp of claim 38, wherein the rare gas fill is mixture of neon, and an additional gas whose constituents may be selected from the group comprising argon, helium, krypton, nitrogen, radon, and xenon, any one of such additional gases provides less than one percent by weight of the total gas fill.

47. A rare gas discharge lamp comprising:

a) an envelope formed of a light transmissive material, the envelope having a wall defining an enclosed volume, b) a first cold electrode extending from the exterior through the wall to be in contact with enclosed volume, c) a second cold electrode extending from the exterior through the wall to be in contact with enclosed volume, d) a neon gas fill with no effective amount of mercury, captured in the enclosed volume capable of providing a first wavelength light output on a first condition of electrical stimulation between the electrodes, and e) a phosphor coating enclosed in the envelope, the phosphor being responsive to the first wavelength light to produce a second wavelength light in the visible range, having a gap formed in the phosphor coating extending axially along the lamp to pass emissions from the phosphor surface, and emissions form the neon fill.

48. The lamp in claim 47, wherein the gap is about 1.0 millimeter wide.

49. The lamp in claim 47, wherein the gap is provides viewing angle of from 35 to 45 degrees from the lamp axis.

50. The lamp in claim 47, having a reflective coating positioned adjacent the envelope, and intermediate the envelope and the phosphor coating.

51. The lamp in claim 45, wherein the gap is about 1.0 millimeter wide.

52. The lamp in claim 49, wherein the gap is provides viewing angle of from 35 to 45 degrees from the lamp axis.

* * * * *